US005133203A

United States Patent [19]

Huang

[11] Patent Number: 5,133,203

[45] Date of Patent: Jul. 28, 1992

[54] AXIAL PIN TUMBLER LOCK

[75] Inventor: Tzong-Chyuan Huang, Feng-Shan, Taiwan

[73] Assignee: Chang-Jie Industrial Co., Ltd., Feng-Shan, Taiwan

[21] Appl. No.: 811,787

[22] Filed: Dec. 20, 1991

[51] Int. Cl.[5] ..... E05B 27/08

[52] U.S. Cl. ..... 70/360; 70/491

[58] Field of Search ..... 70/360, 404, 491, 496

[56] References Cited

U.S. PATENT DOCUMENTS

| | | | |
|---|---|---|---|
| 4,328,691 | 5/1982 | Scherbing | 70/491 |
| 4,878,367 | 11/1989 | Bisbing | 70/491 |
| 5,024,073 | 6/1991 | Lloyd | 70/491 |

*Primary Examiner*—Lloyd A. Gall
*Attorney, Agent, or Firm*—Christie, Parker & Hale

[57] ABSTRACT

A cylinder lock includes a tubular housing in which a fixed hollow cylinder and a rotatable hollow cylinder are coaxially mounted. Several axial bores are formed in an end surface of the fixed hollow cylinder. The rotatable hollow cylinder also has several axial bores formed therethrough. Several tumbler units are received in the bores of the cylinders. Each of the tumbler units consists of a first tumbler pin, a second tumbler pin and a tumbler spring. A locking bar extends through the cylinders. A guide pin is mounted securely on the rotatable hollow cylinder and received slidably in the axially extending slide slot of the locking bar so as to enable synchronous rotation and relative sliding movement of the rotatable hollow cylinder and the locking bar. The engagement of the guide pin in the slide slot retains the locking bar on the lock. A resilient element biases the actuated end of the locking bar to extend from the housing. A spring-loaded retaining element is disposed on the fixed hollow cylinder. The actuated end of the locking bar can be pushed to move inward until the retaining element engages with the positioning hole of the locking bar. At this time, the latching end of the locking bar extends from the housing so as to locate the locking bar in a locked position.

2 Claims, 5 Drawing Sheets

AXIAL PIN TUMBLER LOCK

BACKGROUND OF THE INVENTION

1. Field of the Invention

This invention relates to a lock, more particularly to a cylinder lock.

2. Description of the Related Art

The improvement of this invention is directed to the conventional cylinder lock shown in FIG. 1. As illustrated, the conventional lock includes an outer shell (1), an inner shell (2), a key plug (3), a coiled spring (10) and a tumbler element (30). The spring (10) must be large enough to be sleeved on a locking bar (21) which is integrally formed with the inner shell (2). As a dissatisfactory result, the volume of the lock is increased. Furthermore, when one desires to open the lock, an associated key must be inserted into the lock so as to move the tumbler element (30) to a predetermined position, thereby enabling the spring (10) to move the locking bar (21).

SUMMARY OF THE INVENTION

An object of this invention is to provide a compact cylinder lock.

Another object of this invention is to provide a cylinder lock which can be easily locked without the necessity of a key.

According to this invention, a cylinder lock includes a tubular housing in which a fixed hollow cylinder and a rotatable hollow cylinder are coaxially mounted. Several axial bores are formed in an end surface of the fixed hollow cylinder. The rotatable hollow cylinder also has several axial bores formed therethrough. Several tumbler units are received in the bores of the cylinders. Each of the tumbler units consists of a first tumbler pin, a second tumbler pin and a tumbler spring. A locking bar extends through the cylinders. A guide pin is mounted securely on the rotatable hollow cylinder and received slidably in the axially extending slide slot of the locking bar so as to enable synchronous rotation and relative sliding movement of the rotatable hollow cylinder and the locking bar. The engagement of the guide pin in the slide slot retains the locking bar on the lock. A resilient element biases the actuated end of the locking bar to extend from the housing. A spring-loaded retaining element is disposed on the fixed hollow cylinder. The actuated end of the locking bar can be pushed to move inward until the retaining element engages with the positioning hole of the locking bar. At this time, the latching end of the locking bar extends from the housing so as to locate the locking bar in a locked position. Insertion and rotation of an associated key in the lock can disengage the retaining element from the positioning hole so as to permit the resilient element to push the actuated end of the locking bar to extend from the housing, thereby retracting the latching end of the locking bar into the housing.

BRIEF DESCRIPTION OF THE DRAWING

Other features and advantages of this invention will become apparent in the following detailed description of a preferred embodiment of this invention, with reference to the accompanying drawings, of which.

DETAILED DESCRIPTION OF THE PREFERRED EMBODIMENT

Figure 2:
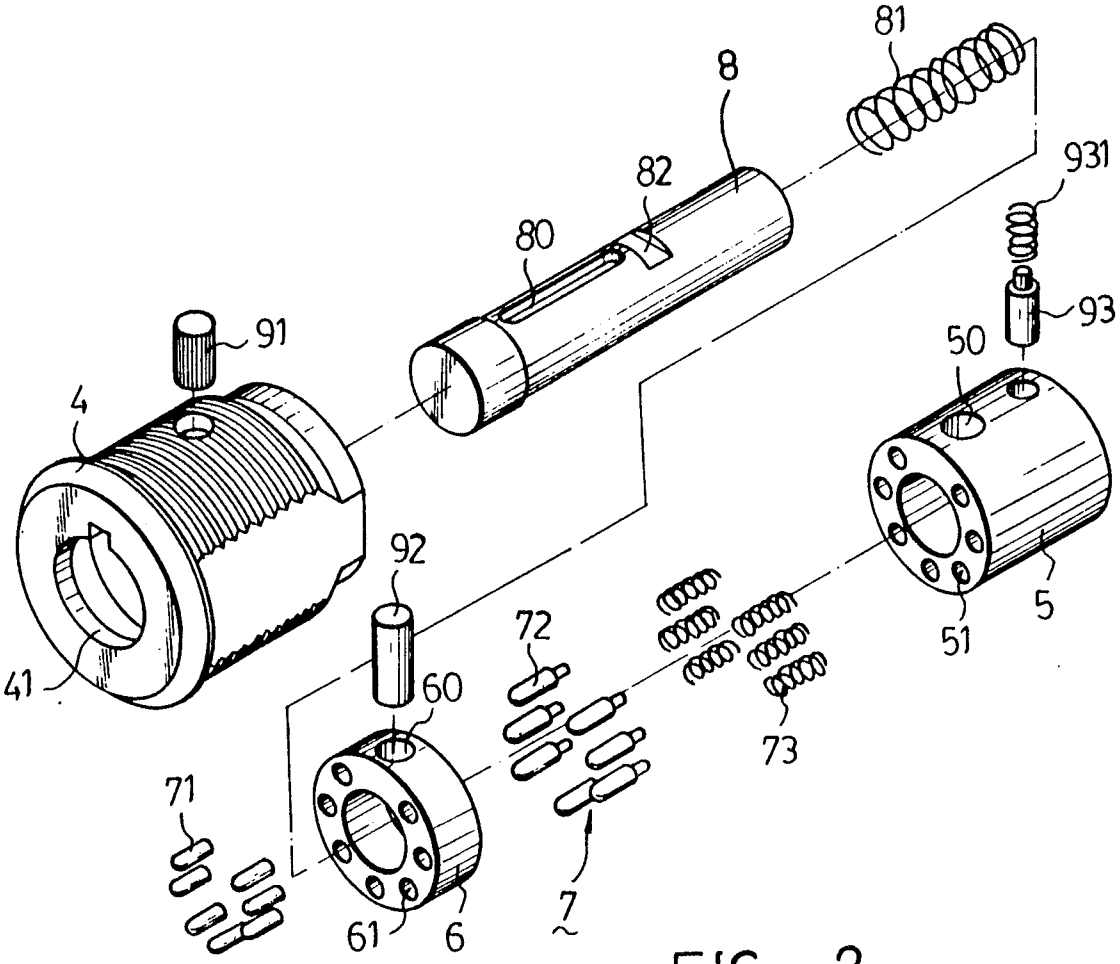
FIG. 2 is an exploded view of a cylinder lock according to this invention.

Referring to FIG. 2, a cylinder lock of this invention includes a tubular housing (4), a fixed hollow cylinder (5), a rotatable hollow cylinder (6), several tumbler units (7) and a locking bar (8).

Figure 3:
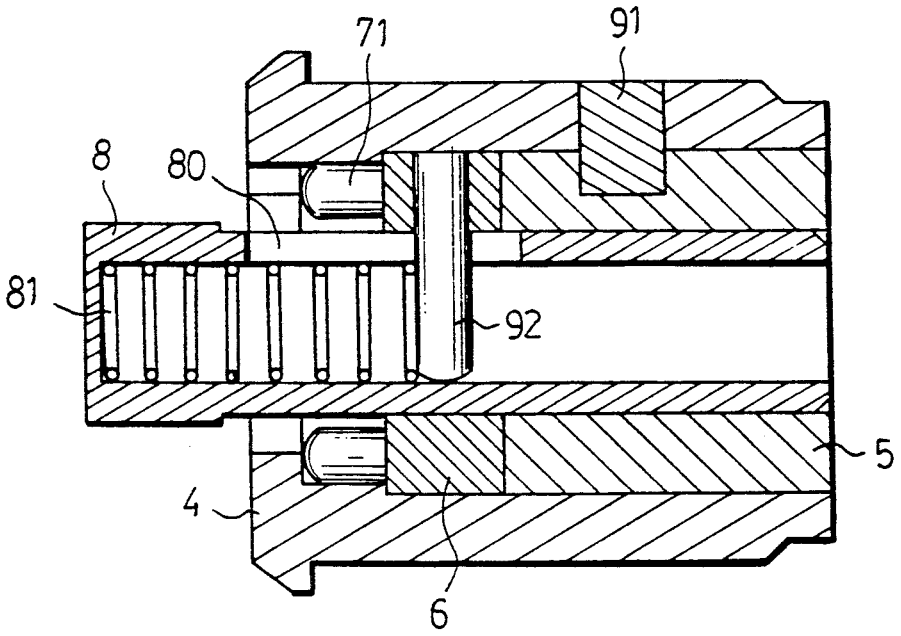
FIGS. 3 and 4 are sectional views illustrating how a guide pin retains a locking bar in the cylinder lock of this invention.
Figure 4:
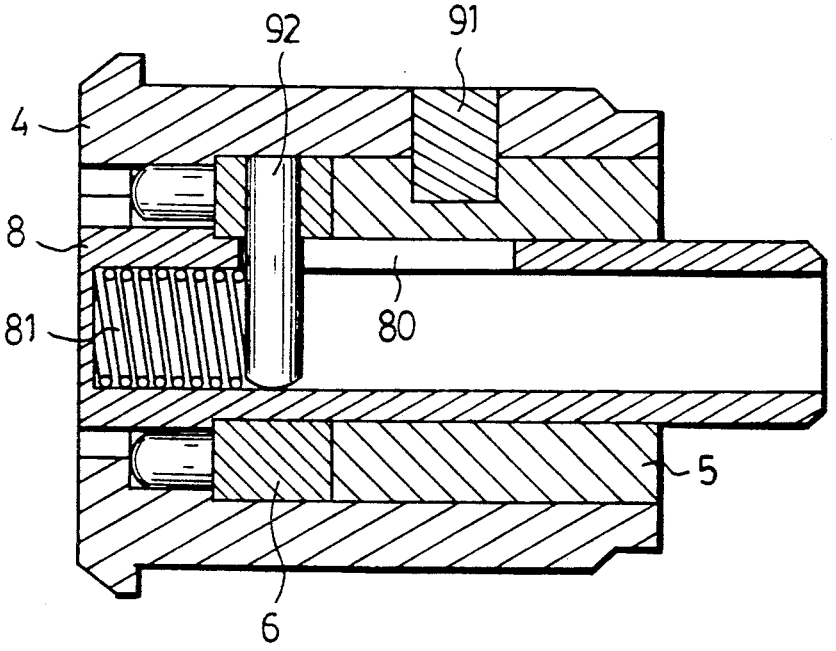

The housing (4) has a radially extending flange (41) projecting inwardly and outwardly from an end thereof. A securing pin (91) is passed through the housing (4) and the hole (50) of the fixed hollow cylinder (5) so as to secure the fixed hollow cylinder (5) to the housing (4). The locking bar (8) is shaped in the form of a hollow cylinder. As best shown in FIGS. 3 and 4, a guide pin (92) extends through the rotatable hollow cylinder (6) and the axially extending slide slot (80) of the locking bar (8) so as to retain the locking bar (8) on the lock in such a manner that the locking bar (8) can slide relative to the rotatable hollow cylinder (6). A coiled compression spring (81) is interposed between the guide pin (92) and the end wall of the locking bar (8) in the locking bar (8) so as to bias the actuated end or closed end of the locking bar (8) to extend from the housing (4), thereby locating the locking bar (8) in an unlocked position.

Figure 5:
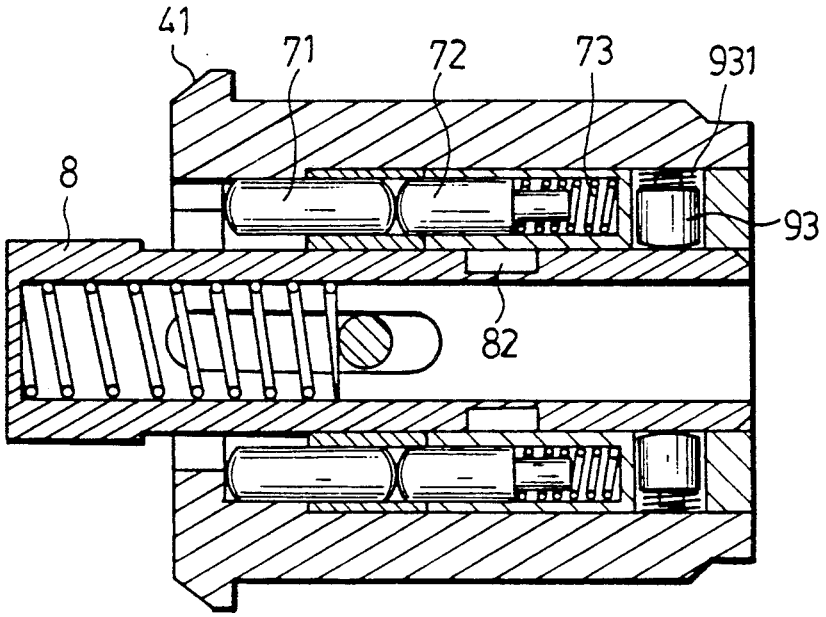
FIG. 5 is a sectional view illustrating the position of a spring-loaded retaining element relative to the locking bar in the cylinder lock of this invention.
Figure 6:
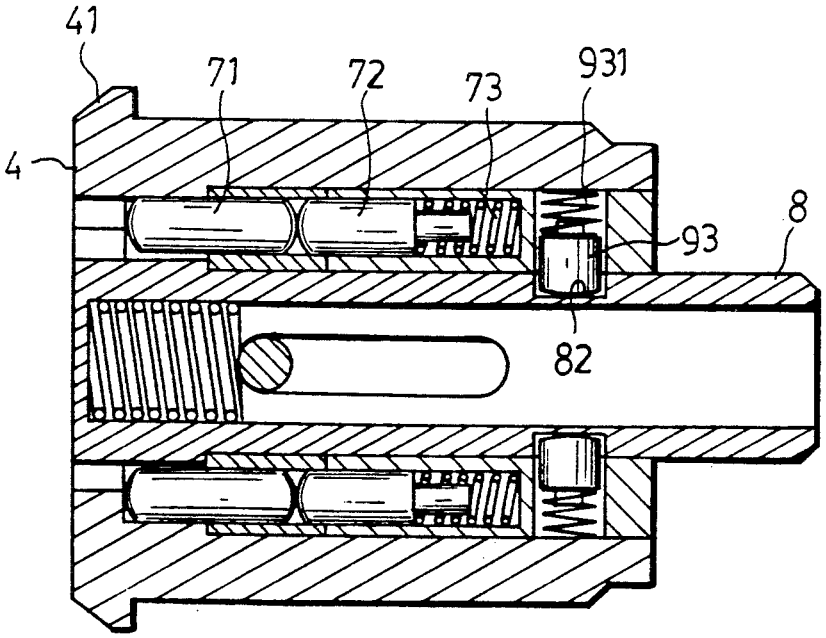
FIG. 6 is a sectional view illustrating how to locate the locking bar in a locked position in the cylinder lock in accordance with this invention.

As best shown in FIG. 5, a spring-loaded retaining element (93) is retained on the fixed hollow cylinder (5) and is biased by a spring (931) to press against the outer surface of the locking bar (8). One can push the actuated end of the locking bar (8) to move inward until the retaining element (93) engages with the positioning hole (82) of the locking bar (8). As shown in FIG. 6, the engagement of the retaining element (93) in the positioning hole (82) locates the locking bar (8) in a locked position in which the latching end or open end of the locking bar (8) extends from the housing (4).

Again referring to FIG. 2, several axial bores (51) are formed in an end surface of the fixed hollow cylinder (5) which contacts the rotatable hollow cylinder (6). The rotatable hollow cylinder (6) also has several axial bores (61) formed therethrough in alignment with the bores (51) of the fixed hollow cylinder (5). As best shown in FIGS. 5 and 6, each of the tumbler units (7) is received in the bores (51 and 61) and consists of a first tumbler pin (71) positioned in the bore (61) of the rotatable hollow cylinder (6), a second tumbler pin (72) spanning a shear line between the fixed hollow cylinder (5) and the rotatable hollow cylinder (6), and a tumbler spring (73) biasing the first tumbler pin (71) to extend from the bore (61). The first tumbler pins (71) have different lengths.

Figure 7:
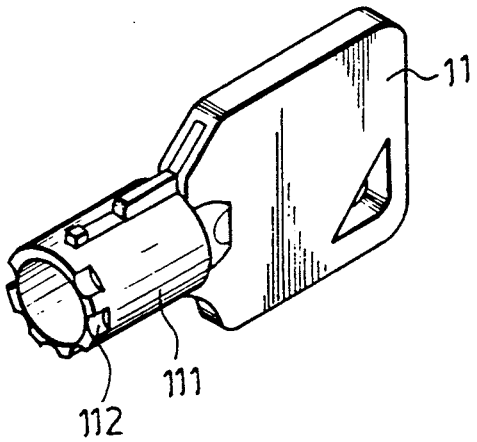
FIG. 7 hows a key to be used with the cylinder lock of this invention.

FIG. 7 shows a key (11) which is associated with the cylinder lock of this invention. As illustrated, the key (11) has a sleeve-like operating portion (111) which is formed with several key cuts (112) of different sizes.

The sizes of the key cuts (112) are determined according to the positions and lengths of the first tumbler pins (71). Referring to FIG. 6, when one desires to open the lock, the key (11) is inserted into the space between the flange (41) of the housing (4) and the actuated end of the locking bar (8) so as to engage the first tumbler pins (71) with the key cuts (112) of the key (11), thereby positioning the first and second tumbler pins (71, 72) of each of the tumbler units (7) on two sides of the shear line between the fixed hollow cylinder (5) and the rotatable hollow cylinder (6). At this time, the engagement of the first tumbler pins (71) in the key cuts (112) enables synchronous rotation of the rotatable hollow cylinder (6) and the key (11). Subsequently, the key (11) is turned to rotate the locking bar (8) synchronously with the rotatable hollow cylinder (6) so as to disengage the spring-loaded retaining element (93) from the positioning hole (82) of the locking bar (8). As a consequence, the latching end of the locking bar (8) is pulled by the coiled compression spring (81) into the housing (4) so as to urge the actuated end of the locking bar (8) to extend from the housing (4).

Figure 1:
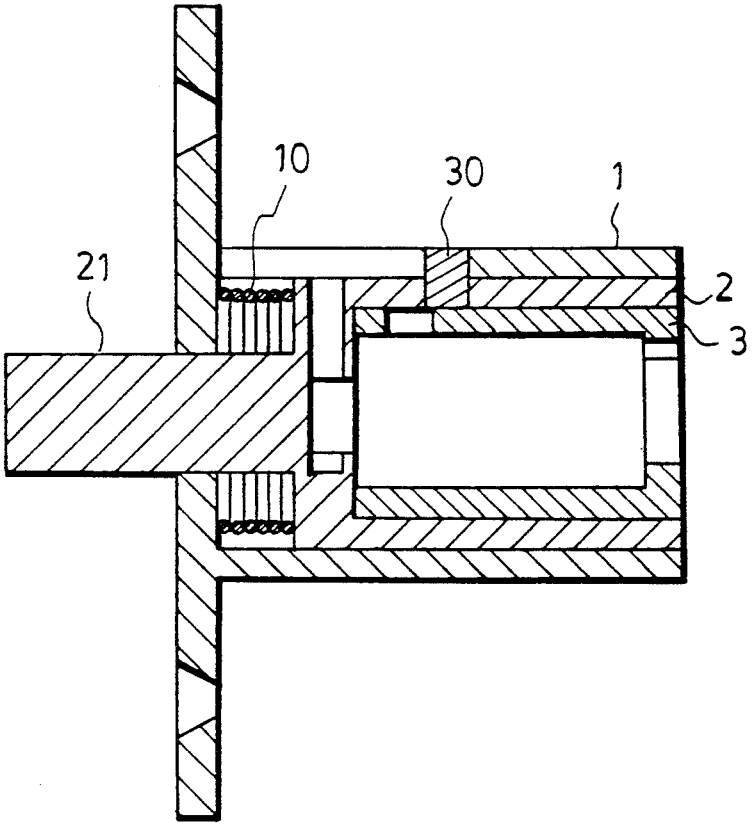
FIG. 1 PRIOR ART
FIG. 1 is a sectional view of a conventional cylinder lock.

Because the size of the coiled compression spring (81) is reduced in comparison with that of the spring (10) of the conventional lock shown in FIG. 1, the volume of the lock of this invention can be reduced so as to increase the application range of the lock. Furthermore, the lock of this invention can be easily locked without the need of a key.

With this invention thus explained, it is apparent that numerous modifications and variations can be made without departing from the scope and spirit of this invention. It is therefore intended that this invention be limited only as indicated in the appended claims.

I claim:

1. A cylinder lock comprising:

a tubular housing;

a fixed hollow cylinder secured in said housing and having several axial bores formed in an end surface of said fixed hollow cylinder;

a rotatable hollow cylinder, mounted rotatably in said housing, abutting against and coaxial with said fixed hollow cylinder, including several axial bores formed through said rotatable hollow cylinder in alignment with said bores of said fixed hollow cylinder, and a guide pin mounted securely on said rotatable hollow cylinder;

a locking bar, disposed rotatably in said housing, slidable between a locked position and an unlocked position in said housing, having an actuated end extending from an end of said housing, a latching end located in said housing, an axially extending slide slot formed in said locking bar so that said guide pin is received slidably in said slide slot, and a positioning hole formed in said locking bar, engagement of said guide pin in said slide slot enabling synchronous rotation of said rotatable hollow cylinder and said locking bar;

a spring-loaded retaining element provided on said fixed hollow cylinder and biased to press against said locking bar;

several tumbler units respectively received in said bores of said fixed and rotatable hollow cylinders, each of said tumbler units consisting of a first tumbler pin positioned in said rotatable hollow cylinder, a second tumbler pin spanning a shear line between said fixed and rotatable hollow cylinders, and a tumbler spring positioned in said fixed hollow cylinder so as to bias said first tumbler pin to extend from said bore of said rotatable hollow cylinder, at least two of said first tumbler pins having different lengths;

a resilient element biasing said actuated end of said locking bar to extend from said housing so as to position said locking bar in said unlocked position;

whereby, when said actuated end of said locking bar is pushed into said housing, said spring-loaded retaining element engages in said positioning hole of said locking bar so as to position said locking bar in said locked position, thereby extending said latching end of said locking bar from said housing; when said locking bar is in said locked position, insertion and rotation of an associated key in said lock position said first and second tumbler pins of each of said tumbler units on two sides of the shear line so that said locking bar rotates synchronously with said rotatable hollow cylinder, thereby disengaging said spring-loaded retaining element from said positioning hole of said locking bar, disengagement of said spring-loaded retaining element from said positioning hole causing said resilient element to push said actuated end of said locking bar to extend from said housing.

2. A cylinder lock as claimed in claim 1, wherein said locking bar is in the form of a hollow cylinder, said actuated end of said locking bar being closed, said latching end of said locking bar being open, said slide slot being formed through a wall of said locking bar, said guide pin extending into said locking bar, said resilient element being a coiled compression spring which is positioned between said guide pin and said closed end of said locking bar in said locking bar so as to push said closed end of said locking bar to extend from said housing.

* * * * *